US005354068A

United States Patent [19]

Maleski

[11] Patent Number: 5,354,068

[45] Date of Patent: Oct. 11, 1994

[54] BROADHEAD FOR AN ARROW AND METHOD OF SECUREMENT

[76] Inventor: Richard Maleski, 4 South St., Plymouth, Conn. 06782

[21] Appl. No.: 781,114

[22] Filed: Oct. 22, 1991

Related U.S. Application Data

[63] Continuation-in-part of Ser. No. 637,452, Jan. 4, 1991, Pat. No. 5,145,186.

[51] Int. Cl.[5] ..... F42B 6/08

[52] U.S. Cl. ..... 273/422; 403/371

[58] Field of Search ..... 273/416, 419–422; 403/297, 371

[56] References Cited

U.S. PATENT DOCUMENTS

| | | | |
|---|---|---|---|
| 310,553 | 9/1890 | Kania et al. | D22/115 |
| 314,416 | 5/1891 | Rezmer | D22/115 |
| 653,642 | 7/1900 | Darling | 403/371 X |
| 1,038,834 | 9/1912 | Bloom | 403/371 X |
| 1,604,713 | 10/1926 | Norlund | 273/421 |
| 2,137,014 | 11/1938 | Brochu | 273/421 |
| 2,212,345 | 8/1940 | Krieger | 273/421 X |
| 2,308,542 | 1/1943 | Raybould | 403/297 |
| 2,820,634 | 1/1958 | Vance | 273/421 |
| 2,925,278 | 2/1960 | Sweetland | 273/419 |
| 2,930,620 | 3/1960 | Brooks . | |
| 2,940,758 | 6/1960 | Richter | 273/419 X |
| 3,036,395 | 5/1962 | Nelson . | |
| 3,401,938 | 9/1968 | Bear | 273/421 X |
| 3,614,103 | 10/1971 | Carroll | 273/422 |
| 3,741,542 | 6/1973 | Karbo | 273/422 |
| 3,868,114 | 2/1975 | Groner | 273/419 |
| 3,897,062 | 7/1975 | Christensen | 273/421 |
| 3,910,579 | 10/1975 | Sprandel . | |
| 3,923,310 | 12/1975 | Lowy . | |
| 4,006,901 | 2/1977 | Simo . | |
| 4,036,499 | 7/1977 | Sherwin | 273/422 |
| 4,093,230 | 6/1978 | Simo . | |
| 4,152,086 | 5/1979 | Achenbach et al. | 403/297 X |
| 4,210,330 | 7/1980 | Kosbab | 273/422 |
| 4,349,202 | 9/1982 | Scott | 273/422 |
| 4,381,866 | 5/1983 | Simo | 273/422 |
| 4,452,460 | 6/1984 | Adams | 273/422 |
| 4,505,482 | 3/1985 | Martin, Sr. | 273/421 |
| 4,533,146 | 8/1985 | Schaar | 273/422 |
| 4,558,868 | 12/1985 | Musacchia | 273/422 |
| 4,565,377 | 1/1986 | Troncoso, Jr. et al. | 273/422 |
| 4,570,941 | 2/1986 | Saunders | 273/422 |
| 4,621,817 | 11/1986 | Musacchia | 273/421 |
| 4,643,435 | 2/1987 | Musacchia | 273/422 |
| 4,706,965 | 11/1987 | Schaar | 273/416 |
| 4,772,029 | 9/1988 | Watkins | 273/416 |
| 4,781,386 | 11/1988 | Armitage | 273/422 |
| 4,943,067 | 7/1990 | Saunders | 273/416 |
| 4,944,520 | 7/1990 | Fingerson et al. | 273/419 |
| 5,046,744 | 9/1991 | Eddy | 273/421 |

*Primary Examiner*—Paul E. Shapiro
*Attorney, Agent, or Firm*—Dilworth & Barrese

[57] ABSTRACT

A broadhead for an arrow having a locking mechanism which insures true alignment of the longitudinal axis of the broadhead with the longitudinal axis of the shaft of the arrow. A securing member has longitudinal slots extending from opposite ends thereof. Each slot extends more than half the length of the securing member. The securing member is positioned over and screwed to an inner member, which is one of the arrow shaft and broadhead, and fitted within an outer member, which is the other of the arrow shaft and broadhead. When the inner member is screwed to the securing member the latter expands radially pressing it firmly against the inside of the outer member to secure the broadhead to the shaft. Because the securing member has longitudinally overlapping slots extending from opposite ends the radial expansion is uniform over the length of the securing member.

28 Claims, 4 Drawing Sheets

BROADHEAD FOR AN ARROW AND METHOD OF SECUREMENT

CROSS-REFERENCE TO RELATED APPLICATIONS

This application is a continuation-in-part of copending application Ser. No. 07/637,452, filed on Jan. 4, 1991, now U.S. Pat. No. 5,145,186.

BACKGROUND OF THE INVENTION

1. Field of the Invention

The present invention relates to broadheads for arrows, and more particularly, to a means for securing the broadhead to the shaft of the arrow. A method of securing the broadhead to the shaft of the arrow is also disclosed.

2. Discussion of the Prior Art

Arrows having broadheads secured by various means to the arrow shaft are well known in the art. Means of securement of the broadhead to the arrow shaft typically include a threaded post which extends from the broadhead which is screwed directly into a tapped end of the arrow shaft or an adapter which is generally secured to the shaft by adhesives, which allows the broadhead to be screwed into the adapter to secure it to the shaft.

Various means for securing the broadhead to the arrow have been developed in an effort to provide an aerodynamically balanced arrow which maintains its accuracy during flight. In addition to the tapped post of the broadhead being screwed into the arrow shaft, several other means are provided which include adhesives, crimping, or threaded tubes which secure the broadhead to the arrow shaft by screwing the broadhead into one end of the tube while screwing the arrow shaft into the other end.

Typical securement devices incorporating a threaded post on the body of the broadhead which is screwed into an adapter or directly into the arrow shaft itself are disclosed in, for instance, U.S. Pat. No. 2,940,758 to Richter, U.S. Pat. No. 4,452,460 to Adams, U.S. Pat. No. 3,741,542 to Karbo and U.S. Pat. No. 4,036,499 to Sherwin, among others.

Many other prior art arrows provide a hollow end of the arrow shaft which allows for securement of the broadhead to the shaft by crimping the shaft about a post on the broadhead or a separate post to which the broadhead is also mounted. Arrows of this type are disclosed in, for instance, U.S. Pat. No. 4,533,146 to Schaar, U.S. Pat. No. 4,706,965 to Schaar, U.S. Pat. No. 4,772,029 to Watkins, and U.S. Pat. No. 4,943,067 to Saunders.

Prior means for securement of the broadhead to the arrow shaft such as those disclosed above are subject to several disadvantages which primarily affect the performance of the arrow during use. In particular, the use of many known adapter members to secure the broadhead to the arrow shaft end subjects the end of the arrow to the additional weight of the adapter member itself as well as the adhesive or glue used to secure the adapter to the shaft. Furthermore, as is a problem with all threaded engagement means utilizing the threaded post of the broadhead, such as the threads required on the adapter or on the inner surface of the arrow shaft itself, the provision of such threads requires precise machining to insure that the broadhead is firmly secured to the arrow shaft for perfect alignment with the longitudinal axis of the shaft. Any deviation of the longitudinal axis of the broadhead from the longitudinal axis of the shaft will consequently result in an arrow which is improperly balanced and aerodynamically incorrect. The accuracy of the flight of the arrow during use will be compromised to a degree which may mean the difference between hitting or missing a target. A further disadvantage to the use of known adapter members lies in the fact that the curing time of the adhesive used to secure an adapter to the shaft slows the assembly process by requiring drying time for the adhesive. Furthermore, if the adhesive is not properly applied, the balance of the arrow may be thrown off which will affect its accuracy during flight.

A disadvantage encountered in the arrows having a broadhead crimped to an end of the shaft is also related to the balance and aerodynamic characteristics of the arrow. If the crimping is not uniform, the longitudinal axis of the broadhead may not align with the longitudinal axis of the shaft and therefore provide an unbalanced and aerodynamically incorrect arrow. Furthermore, the end weight of the crimping member results in an arrow whose forward end is overly weighted, and which will affect performance.

The novel broadhead securement means of the present invention obviates the disadvantages encountered in the prior art and provides an efficient means for securing the broadhead to an arrow shaft which maintains the balance and aerodynamic performance of the arrow. The means for securing the broadhead to the arrow of the present invention also provides a quicker and more efficient assembling process during manufacture.

SUMMARY OF THE INVENTION

The present invention provides a novel means for securing a broadhead to an arrow shaft which maintains the balance and aerodynamic properties of the arrow without adding appreciable additional weight to the broadhead end of the arrow. The means for securing the broadhead to the arrow shaft reduces the requirement for exact precision machining present in prior art arrows while providing a precise alignment of the longitudinal axis of the broadhead with the longitudinal axis of the arrow shaft.

The means for securing the broadhead to the arrow shaft of the present invention may be used with any arrow, harpoon, spear or similar device requiring a broadhead attachment to the shaft of the projectile. The perfectly aligned and balanced arrow resulting from the means of securement of the present invention maintains the aerodynamic properties of the arrow and insures accuracy in flight.

In a first embodiment, the securement means of the present invention essentially comprises a broadhead having a pointed tip at one end and a longitudinal bore at the other end, and provides a plurality of blades on the body portion of the broadhead. The end of the broadhead body at the longitudinal bore is provided with a threaded portion for accepting a locking nut, and preferably at least one axial slot is provided at the threaded portion for tightening purposes.

During assembly, the locking nut is slipped over the arrow shaft and the arrow shaft is then inserted into the longitudinal bore of the broadhead body. As the locking nut is tightened to the threaded portion of the broadhead body, the body is tightened about the shaft by collapsing the body about the shaft at the axial slots.

The locking nut is provided with a tapered surface at the entrance to the threads which mates with a tapered portion of the body of the broadhead so that as the nut is tightened the broadhead body is squeezed about the arrow shaft to frictionally secure the shaft within the body. Preferably, at least two axial slots are provided about the threaded portion, so that as the nut is tightened, the body is squeezed about the shaft in a uniform manner to insure that the longitudinal axis of the broadhead is perfectly aligned with the longitudinal axis of the arrow shaft.

Alternately, a ferrule or ring may be provided as a locking flange about the arrow shaft which is then slid into the longitudinal bore of the body member of the broadhead so that upon tightening of the locking nut the body member is deformed to fit about the ferrule and secure the broadhead to the arrow shaft in a uniform and balanced manner to maintain the alignment of the longitudinal axes of both the broadhead and the shaft. The use of such a ferrule allows for the assembly of an arrow by applying a broadhead to any size shaft having various diameters which still provides for an arrow which is aerodynamically correct and balanced to insure accuracy of flight.

In a second embodiment, a typical broadhead is provided which includes a shank portion having a pointed tip at one end and terminating in a post member at a second end. The post member is preferably threaded, and the shank portion is further provided with a plurality of blades positioned thereon. The broadhead is secured to a hollow arrow shaft by the securement means of the present invention.

The means for securing a broadhead to the arrow shaft comprises a locking member having a cylindrical body and at least one axial slit extending substantially the length of the body. A circumferential flange may be provided, preferably about an end of the body. The axial slit is provided to allow for expansion of the body of the locking member to secure the broadhead to the arrow shaft. Preferably, the body has a central bore and includes internal threads within the bore. The body may also have a tapered cross-section at the central bore such that the internal diameter at a first end is greater than the internal diameter at a second end. Preferably, the second end is threaded.

In use, the locking member, having a diameter which is slightly less than an inner diameter of the arrow shaft, is inserted into the shaft so that the tapered end faces inwardly; i.e., the end having the larger diameter is at the end of the shaft. The broadhead is then inserted into the central bore and is rotated so that the threads of the post engage the internal threads of the bore. Rotation of the broadhead expands the locking member at the axial slit to frictionally lock the locking member, and thus the broadhead, onto the shaft of the arrow.

In a third embodiment, the broadhead has a pointed tip at one end of the shank and an axial bore at a second end of the shank which extends partially along the length of the shank. The shaft of the arrow terminates in a threaded end, or preferably, a threaded post. A locking member similar to that disclosed above is also provided.

In use, the locking member, having a diameter slightly smaller than an inner diameter of the axial bore of the broadhead shank, is inserted into the axial bore with the tapered, threaded end inward. The threaded end of the shaft is then inserted into the central bore of the locking member and rotated within the bore to expand the locking member at the axial slit, thus frictionally locking the shaft onto the broadhead.

The novel securement means of the present invention provides for a quick and efficient assembly process for securing a broadhead to an arrow shaft. The locking member is lightweight and insures precise alignment of the broadhead to the longitudinal axis of the arrow shaft, thus providing for accurate flight by maintaining the aerodynamic properties of the arrow.

BRIEF DESCRIPTION OF THE DRAWINGS

The foregoing features of the present invention will become more readily apparent and may be understood by referring to the following detailed description of an illustrative embodiment of the broadhead of the present invention and its novel means for securing the broadhead to the shaft of an arrow, taken in conjunction with the accompanying drawings, in which.

DETAILED DESCRIPTION OF THE PREFERRED EMBODIMENT

Figure 1:
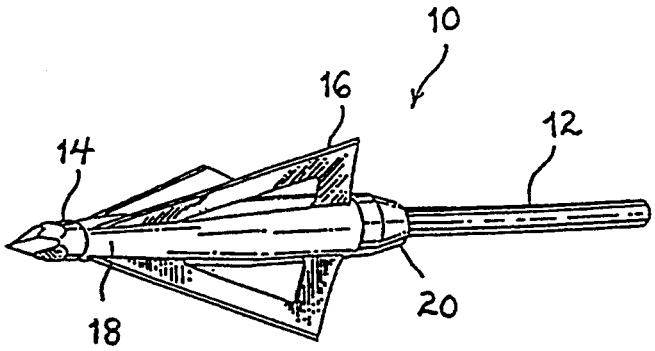
FIG. 1 illustrates a perspective view of an arrow having the broadhead of the present invention secured to a shaft.

Referring now in specific detail to the drawings, in which like reference numerals identify similar or identical elements throughout the several views, FIG. 1 shows the broadhead 10 of the present invention secured to a shaft 12. Broadhead 10 includes a pointed tip 14 at one end which is attached to a body portion 18 along with blades 16. The broadhead 10 is secured by a locking mechanism 20 to the shaft 12 of the arrow.

Figure 2:
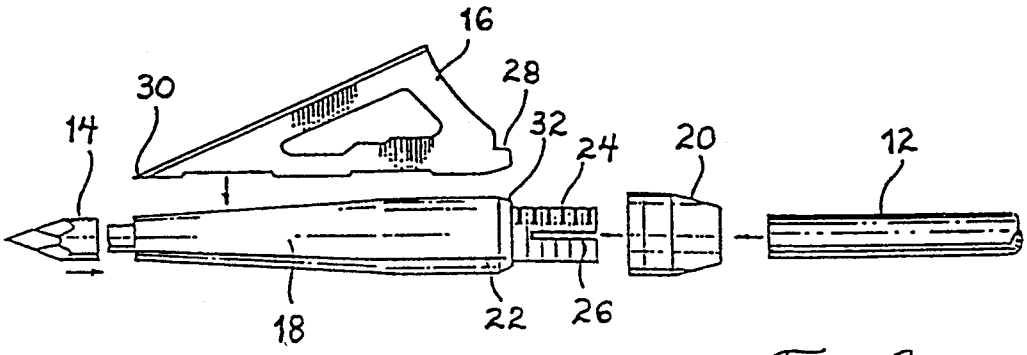
FIG. 2 illustrates a partial exploded view of the broadhead of the present invention having its novel means for securing the broadhead to the shaft of the arrow.
Figure 3:
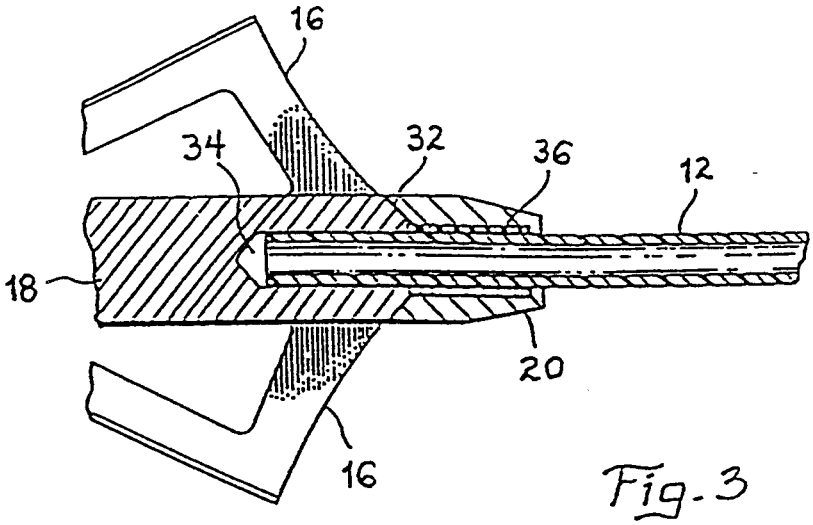
FIG. 3 illustrates a partial cross-sectional view of the assembled broadhead and shaft of the present invention.

FIG. 2 shows the assembly of broadhead 10 to shaft 12, and FIG. 3 shows a cross-section of the fully assembled arrow. As seen in FIGS. 2 and 3, pointed tip 14 is fit onto body member 18 of broadhead 10 so that front edge 30 of blade 16 fits under an edge of pointed tip 14. Blades 16 are secured in slots 22 in body member 18 in a conventional manner. Notch 28 is provided at the rear end of blade 16 for engagement with locking nut 20 to secure blade 16 in the fully assembled broadhead.

As seen in FIG. 3, shaft 12 passes through locking nut 20 into a longitudinal bore 34 of body member 18. As shaft 12 is fit within longitudinal bore 34, locking nut 20 is rotated for engagement with threads 24 of body member 18. Axial slot 26 is provided through threads 24, and preferably a pair of slots 26 communicate with longitudinal bore 34. As locking member 20 is rotated, the spacing defined by slots 26 is reduced, and body member 18 at threads 24 is squeezed about shaft 12 to frictionally secure shaft 12 within longitudinal bore 34 as best seen at 36 in FIG. 3.

Body member 18 has a larger diameter at the area adjacent blades 16 than at the area of threads 24, and tapered edge 32 is provided between body member 18 and threads 24. A corresponding tapered edge is provided in locking member 20 so that as locking member 20 is tightened about threads 24, the tapered edges meet to further squeeze body member 18 about shaft 12 to frictionally secure the shaft within the body member. Engagement of the edge 32 with locking member 20 is best seen in FIG. 3.

Figure 4:
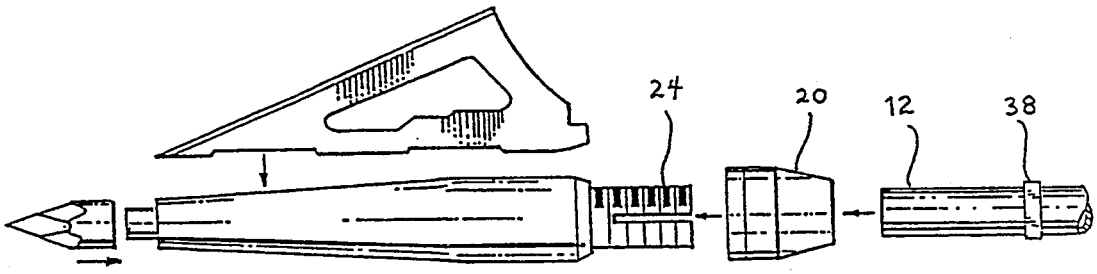
FIG. 4 illustrates a partial exploded view of an alternate embodiment of the present invention.
Figure 5:
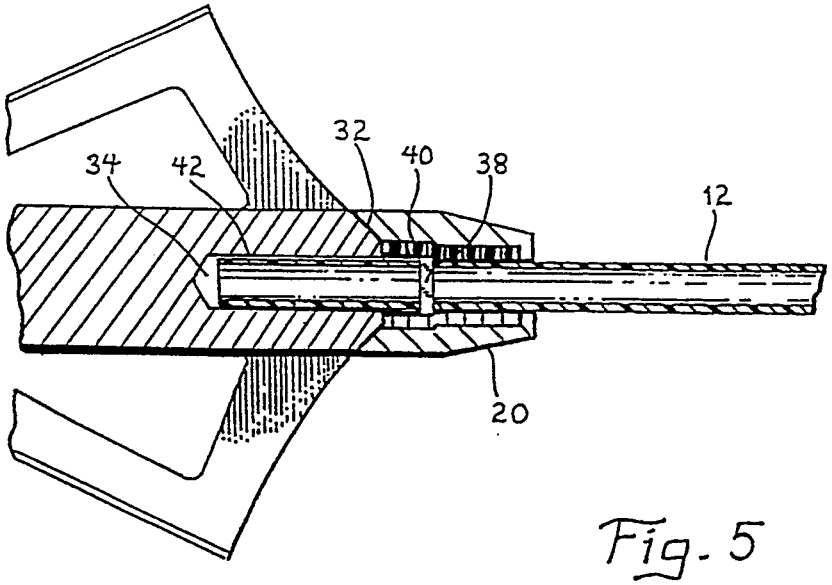
FIG. 5 illustrates a partial cross-sectional view of the broadhead of FIG. 4 showing its securement to the shaft of an arrow.

FIG. 4 illustrates an alternate embodiment of the broadhead securement means in which a shaft having a diameter which is less than a diameter of longitudinal bore 34 may be secured to the broadhead without compromising the alignment of the longitudinal axis of the broadhead with the longitudinal axis of the shaft. The embodiment of FIG. 4 provides a ring or ferrule 38 which is slipped about shaft 12 which approximates the diameter of longitudinal bore 34. As seen in FIG. 5, a space 42 exists between body member 18 and shaft 12 when the shaft is inserted into the broadhead. In use, locking member 20 is slipped over shaft 12 followed by ferrule 38, which may comprise a metallic member or an 0-ring constructed of, for instance, a nylon or other hard plastic material. Ferrule 38 may also be provided with a slot which allows for the adjustment of the ferrule about the shaft 12.

Shaft 12 is then slipped into longitudinal bore 34 so that ferrule 38 is inside the bore at threaded portion 24. When locking member 20 is rotated about threads 24, body member 18 deforms about the ferrule 38 as shown at 40 to frictionally lock shaft 12 within body member 18. Tapered edge 32 allows locking member 20 to be tightened securely to insure the alignment of longitudinal axes of the broadhead and the shaft to insure balance and aerodynamic alignment.

Figure 6:
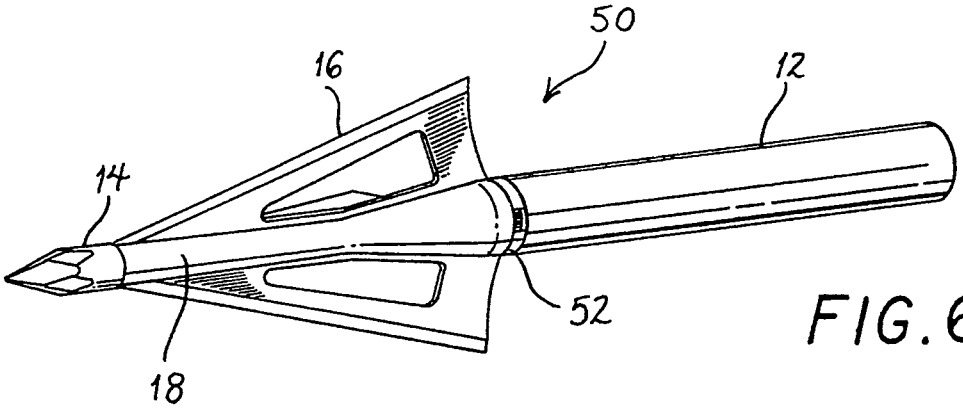
FIG. 6 illustrates a perspective view of an alternate embodiment of an arrow having the broadhead of the present invention secured to a shaft.
Figure 7:
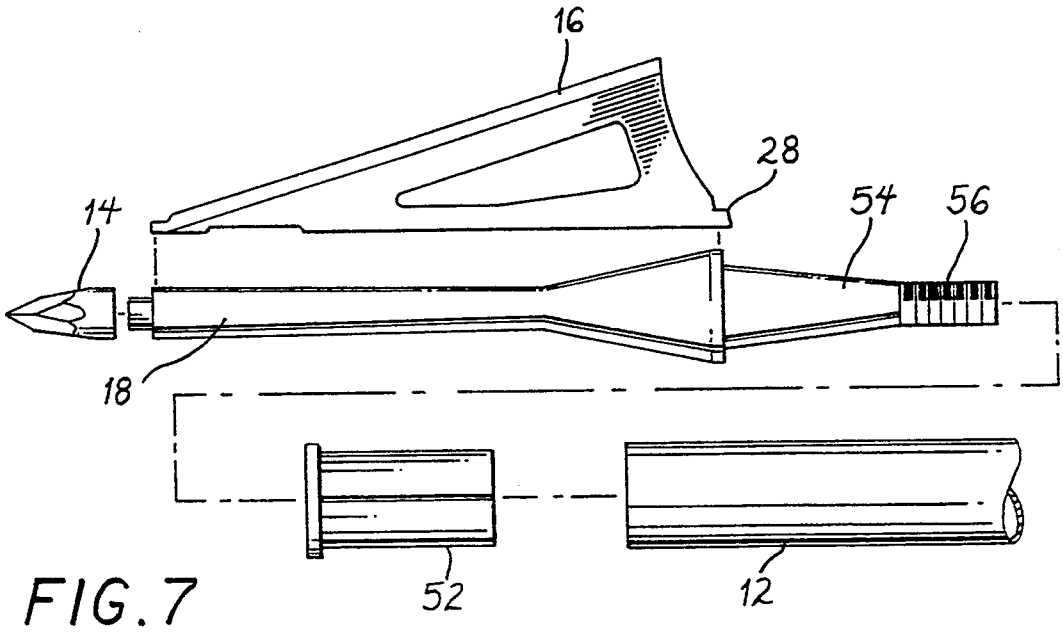
FIG. 7 illustrates a partial exploded view of the broadhead of FIG. 6 having its novel means for securing the broadhead to the shaft of the arrow.

Turning now to FIG. 6, there is shown an alternate embodiment of the broadhead 50 attached to arrow shaft 12 through the provision of locking member 52. Broadhead 50 is similar to broadhead 10, and comprises a shank portion 18 having a plurality of blades 16 attached thereto, and including a pointed tip 14 positioned at a first end of shank portion 18. A best seen in FIG. 7, shank portion 18 terminates at a second end in a post member 54 which preferably has a tapered cross section as shown and terminates in a threaded portion 56. Locking member 52 is positioned within shaft member 12 and then fit over post 54 to engage threads 56 to rotatingly tighten the broadhead 50 to the shaft 12.

Figure 8:
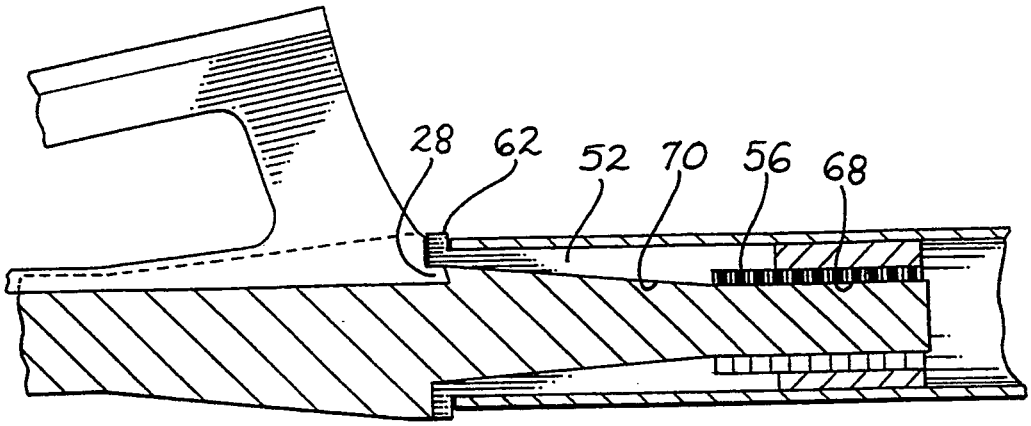
FIG. 8 illustrates a partial cross-sectional view of the assembled broadhead and shaft of FIG. 6.

As seen in FIG. 8, locking member 52 is fit within shaft 12 so that broadhead 50 may be rotatingly secured onto shaft 12 by rotating the broadhead so that threads 56 engage the inner surface of locking member 52.

Figure 9:
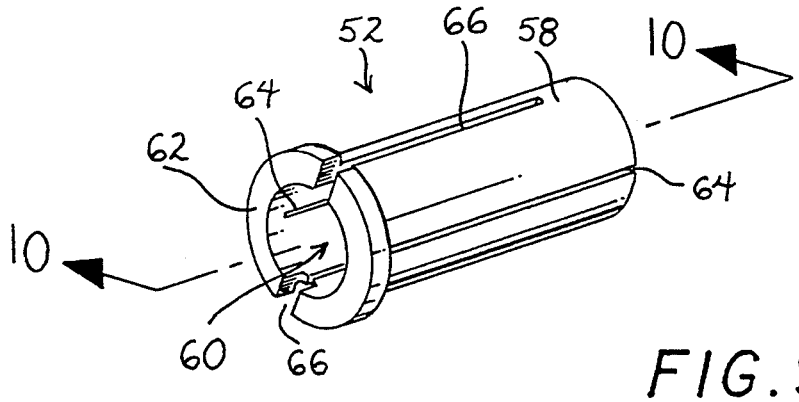
FIG. 9 illustrates a perspective view of the locking member of the present invention.
Figure 10:
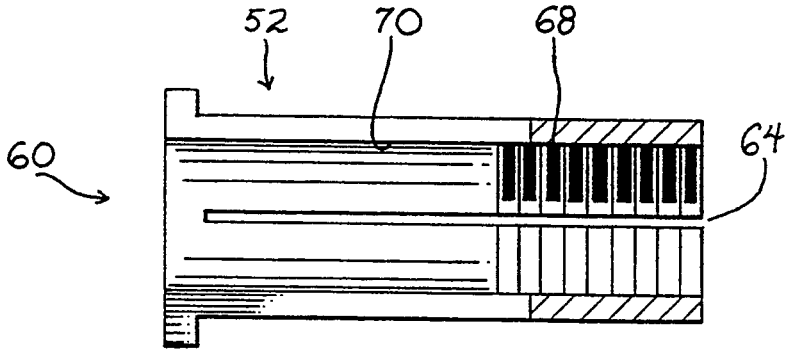
FIG. 10 illustrates a cross-sectional view of the locking member of FIG. 9 taken along lines 10—10.

As best seen in FIGS. 9 and 10, locking member 52 essentially comprises a cylindrical body portion 58 having a central longitudinal bore 60. A circumferential flange 62 may be provided at one end of body portion 58, which is used to abut an end of shaft 12 and to lockingly engage notch 28 of blades 16, as best seen in FIG. 8. Cylindrical body portion 58 also includes at least one axial slit 64, and preferably comprises a plurality of slits including slits 64 extending from the distal end of body portion 58 as well as slits 66 extending from the proximal end through the circumferential flange 62. As is also seen in FIG. 8, the inner surface of central bore 60 may be tapered to correspond in shape to that of the post 54 of the broadhead 50, or alternately, central bore 60 may have a uniform cross section as seen in FIG. 10. Locking member 52 preferably includes internal threads 68 for engaging threads 56 on post 54.

In use, after locking member 52 is fit into the hollow end of shaft 12, post 54 is inserted into the central bore 60 of locking member 52 and broadhead 50 is rotated so that threads 56 engage the internal threads 68. As the broadhead is tightened onto locking member 52, the tapered cross section of post 54 engages the inner tapered surface 70 of central bore 60 and expands locking member 52 at axial slits 64 and 66 so that the expansion causes the frictional locking of locking member 52 to the inner surface of shaft 12. As can be appreciated, the outer diameter of cylindrical body 58 is slightly smaller than the inner diameter of shaft 12. Upon tightening, however, the outer diameter of cylindrical body portion 58 becomes at least equal to the inner diameter of shaft 12 so that further tightening locks locking member 52, and consequently broadhead 50, onto shaft 12.

It is also contemplated that locking member 52 be provided without internal threads 68, so that locking member 52 may be constructed of a material that is self-tapping, such as aluminum. Rotation of the broadhead 50 into the soft aluminum locking member 52 allows threads 56 of post 54 to create its own internal threads on the inner surface 70 of locking member 52. In addition, it is further contemplated that threads 56 be eliminated, so that post 54 is forced into central bore 60, and post 54 is frictionally secured within bore 60, while locking member 52 is frictionally secured within shaft 12.

Figure 11:
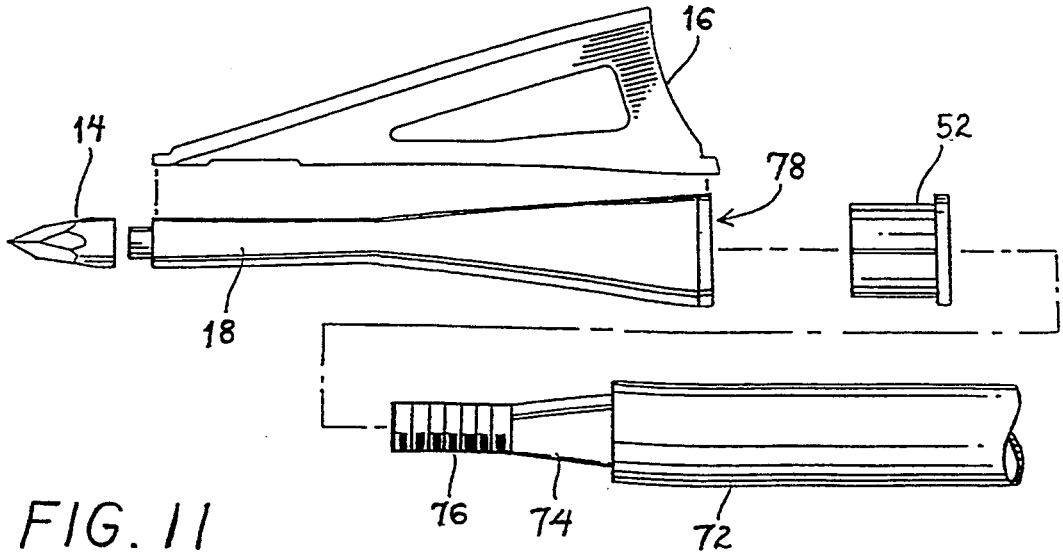
FIG. 11 illustrates a partial exploded view of a third embodiment of the present invention having its novel securement means for securing the broadhead to the shaft of an arrow.

FIG. 11 illustrates an alternate means for securing a broadhead to the shaft according to the present invention. Shank 18 of broadhead 50 includes an axial bore 78 at the end of shank 18 opposite pointed tip 14. Locking member 52 fits within bore 78 and has an outer diameter which is slightly less than the inner diameter of bore 78. Shaft 72 includes a post 74 having threads 76, which fits through central bore 60 of locking member 52 and rotatingly engages the inner surface of locking member 52. Threads 76 engage the inner surface of locking member 52 and cause an outward expansion due to the taper of post 74 which results in the outer diameter of locking member 52 being at least equal to the inner diameter of bore 78 to lock locking member 52 through friction to the inner surface of bore 78 of the broadhead 50. This consequently locks the shaft 72 to the broadhead. Alternately, post member 74 and threads 76 may be eliminated, and shaft 72 may be provided with threads on its outer surface. In this case, a locking member 52 similar to that shown in FIG. 10 may be used.

While the invention has been particularly shown and described with reference to the preferred embodiments, it will be understood by those skilled in the art that various modifications and changes in form and detail may be made therein without departing from the scope and spirit of the invention. Accordingly, modifications such as those suggested above, but not limited thereto, are to be considered within the scope of the invention.

What is claimed is:

1. An arrow comprising a hollow shaft, a broadhead, and means for securing said broadhead to said shaft, said securing means defining a body having a first diameter when inserted into one of said broadhead and said shaft and including at least one longitudinal slot extending from each opposed end of said body and terminating beyond a point intermediate said opposed ends for facilitating uniform radial expansion of said body to a second diameter to frictionally secure said broadhead to said shaft.

2. An arrow according to claim 1, wherein said securing means fits over a shank of said broadhead and within said hollow end of said shaft, such that said shank causes expansion of said securing means to frictionally engage an inner circumferential surface of said shaft.

3. An arrow according to claim 2, wherein said securing means further comprises a flange member about a proximal end for abutting an end of said shaft when said securing means is positioned within said shaft.

4. An arrow according to claim 3, wherein said flange overlies a distal end of a plurality of blades of said broadhead to secure each of said blades on said shank.

5. An arrow according to claim 1, wherein said securing means comprises a cylindrical body portion having at least one longitudinally extending slit to permit expansion from said first diameter to said second diameter to frictionally engage an inner surface of a hollow end of said shaft.

6. An arrow according to claim 5 wherein said cylindrical body includes a central bore having an internal thread for threadingly receiving a shank of said broadhead.

7. An arrow according to claim 6, wherein said shank has a tapered cross section such that a distal end of said shank has a smaller diameter than an intermediate portion of said shank, said distal end being threaded to engage said internal threads of said securing means.

8. An arrow according to claim 7, wherein said taper of said shank expands said securing means upon engagement of said threads of said distal end with said internal threads of said securing means.

9. An arrow according to claim 7, wherein said central bore of said securing means has a taper similar to said taper of said shank.

10. An arrow according to claim 5, wherein said body portion has a central bore having an internal diameter which is smaller than an outer diameter of a shank portion of said broadhead, such that said shank expands said body portion to engage said shaft.

11. A device according to claim 1, wherein said securing means fits over a threaded post member at a proximal end of said shaft and within an axial bore at a distal end of said broadhead, such that said post member causes expansion of said securing means to frictionally engage an inner surface of said broadhead.

12. An arrow including a broadhead, an arrow shaft and a device for securing said broadhead to said arrow shaft, said device comprising:

a cylindrical body portion having a central bore extending therethrough for reception of said broadhead; and at least one axial slit extending from each opposed end of said body portion and terminating beyond a point intermediate said opposed ends of said body portion to permit uniform radial expansion of said body portion within said arrow shaft.

13. An arrow according to claim 12, wherein said arrow shaft is hollow and said body portion has a diameter slightly less than an inner diameter of said shaft, said body portion being slidable into said shaft.

14. An arrow according to claim 13, wherein said broadhead comprises a plurality of blades positioned about and secured to a shank, said shank having a pointed tip at a proximal end and a threaded portion at a distal end, said threaded portion fitting within said central bore of said device.

15. An arrow according to claim 14, wherein said central bore includes internal threads for engaging said threaded portion of said shank.

16. An arrow according to claim 14, wherein said central bore has an inner surface which is self-tapping for engaging said threaded portion of said shank.

17. An arrow according to claim 14, wherein said rotation of said threaded shank within said body portion expands said body portion to frictionally secure said device within said arrow shaft.

18. An arrow according to claim 12, further comprising a flange at a proximal end for abutting an end of said shaft.

19. An arrow according to claim 12, further comprising a plurality of axial slits, at least one slit extending from a proximal end of said body portion a substantial distance of said length.

20. An arrow according to claim 12, wherein said central bore includes a threaded portion at a distal end thereof, said central bore having a tapered axial cross section from said proximal end to said distal end.

21. An arrow according to claim 12, wherein said broadhead includes a plurality of blades positioned about a shank, said shank having a pointed tip at a proximal end and a central opening at a distal end, said central opening having an inner diameter slightly larger than said cylindrical body portion, said cylindrical body portion being slidable into said central opening.

22. An arrow according to claim 21, wherein said arrow shaft includes a threaded post extending from a proximal end, said threaded post engaging an inner surface of said central bore of said body portion, whereby rotation of said shaft threadingly engages said post member with said inner surface to expand said body portion outwardly to frictionally secure said device inside said broadhead shank.

23. A broadhead for an arrow comprising:

a shank portion having a pointed tip at a first end thereof and a threaded post at a second end thereof;

a plurality of blades attached to said shank portion; and a locking member having a central bore extending longitudinally therethrough for accepting said threaded post and at least one axial slit extending along a substantial portion of a length of said locking member from each opposed end thereof and terminating beyond a point intermediate said opposed ends;

wherein said locking member fits within a hollow end of an arrow shaft, and is configured such that rotation of said shank portion effects engagement of said threaded portion with an inner surface of said central bore of said locking member to radially expand said locking member at said axial slits to frictionally secure said locking member to an inner surface of said hollow end of said arrow shaft.

24. A broadhead according to claim 23, wherein said central bore of said locking member includes threads for engaging said post member.

25. A broadhead according to claim 23, wherein said locking member is constructed of a material such that said inner surface of said central bore is self-tapping.

26. A broadhead for an arrow comprising:

a shank portion having a pointed tip at a first end thereof and an axial bore extending partially therethrough from a second end thereof;

a plurality of blades attached to said shank portion; and a locking member having a central bore extending therethrough for accepting an arrow shaft, said arrow shaft having external threads formed thereon, said locking member further having at least one axial slit extending along a substantial portion of a length of said locking member from each opposed end thereof and terminating beyond a point intermediate said opposed ends;

wherein said locking member fits within said axial bore of said shank portion, and is configured such that rotation of said arrow shaft effects engagement of said external threads with an inner surface of said central bore of said locking member to radially expand said locking member at said axial slit to frictionally secure said locking member to an innner surface of said axial bore of said shank portion.

27. A broadhead according to claim 26, wherein said central bore of said locking member includes threads for engaging said threads of said shaft.

28. A broadhead according to claim 26, wherein said locking member is constructed of a material such that said inner surface of said central bore is self-tapping.

* * * * *